United States Patent [19]

Abramson

[11] Patent Number: 4,814,750

[45] Date of Patent: Mar. 21, 1989

[54] WINDOW SCREEN ALARM

[75] Inventor: Steven Abramson, Rochester, N.Y.

[73] Assignee: Pace Window & Door Corp., Rochester, N.Y.

[21] Appl. No.: 125,798

[22] Filed: Nov. 20, 1987

[51] Int. Cl.[4] ..... G08B 13/00

[52] U.S. Cl. ..... 340/550; 340/691; 340/693

[58] Field of Search ..... 340/550, 691, 693

[56] References Cited

U.S. PATENT DOCUMENTS

| | | | |
|---|---|---|---|
| 181,078 | 8/1876 | Larned | 340/550 |
| 1,031,535 | 7/1912 | Di Giovanni | 340/550 |
| 1,099,480 | 6/1914 | Winter | 340/550 |
| 1,252,834 | 1/1918 | Pastore | 340/550 |
| 1,630,808 | 5/1927 | Siegerdt | 340/550 X |
| 1,712,771 | 5/1929 | Kohler | 340/550 X |
| 2,101,040 | 12/1937 | Bayley et al. | 340/550 X |
| 2,205,945 | 6/1940 | Estes | 340/550 X |
| 2,547,283 | 4/1951 | Purdin | 340/550 X |
| 2,600,581 | 6/1952 | Schenendorf | 335/207 |
| 3,051,935 | 8/1962 | Willson | 340/550 |
| 3,426,166 | 2/1969 | Canceill | 200/61.62 |
| 3,470,554 | 9/1969 | Corbell | 340/513 |
| 3,594,770 | 7/1971 | Ham | 340/550 |
| 3,696,373 | 10/1972 | Dunn et al. | 340/550 X |
| 3,706,090 | 12/1972 | Callaghan | 340/547 |
| 3,725,891 | 4/1973 | Miller | 340/550 |
| 3,863,242 | 1/1975 | Minton | 340/550 |
| 3,943,485 | 3/1976 | Waldman | 340/517 |
| 4,232,310 | 11/1980 | Wilson | 340/550 |
| 4,275,391 | 6/1981 | Okamura | 340/571 |
| 4,293,778 | 10/1981 | Williams | 307/147 |
| 4,335,376 | 6/1982 | Marquardt | 340/547 |
| 4,376,935 | 3/1983 | Castaldo | 340/571 |
| 4,427,975 | 1/1984 | Kinzie | 340/547 |
| 4,516,114 | 5/1985 | Cook | 340/542 |
| 4,677,424 | 6/1987 | Hollinger | 340/547 |
| 4,679,034 | 7/1987 | Kamada | 340/691 X |

*Primary Examiner*—Glen R. Swann, III
*Assistant Examiner*—Thomas J. Mullen, Jr.
*Attorney, Agent, or Firm*—Browdy & Neimark

[57] ABSTRACT

A protective screen with burglar alarm includes a full screen wired in a closed circuit fashion connected to a keyed box alarm. The unit is self-contained with each window having its own power source and alarm, including preferably audio and visual alarms. A magnetic connection is also provided so that if the screen is pushed out of its frame without actually cutting the screen, the alarm will sound.

3 Claims, 2 Drawing Sheets

WINDOW SCREEN ALARM

FIELD OF INVENTION

The present invention relates to protective screens for windows and/or doors, and more particularly to a burglar proof screen structure adapted to be mounted within a window frame or the like and which incorporates electrical circuitry which upon removal of the screen or the cutting thereof will actuate an alarm circuit.

BACKGROUND OF THE INVENTION

Protective screens of the general type outlined above are well known and many examples appear in the patent literature. Among these there may be mentioned the U.S. Pat. Nos. to Willson 3,051,935; Callaghan 3,706,090; Purdin 2,547,283; Wilson 4,232,310; Minton 3,863,242; Siegerdt 1,630,808; Winter 1,099,480; Dunn et al. 3,696,373; Williams 4,293,778; Kohler 1,172,771; Estes 2,205,945; Larned 181,078; Miller 3,725,891; Pastore 1,252,834; Di Giovanni 1,031,535.

Many of these devices are adequate, particularly the more recent ones. Nevertheless, all suffer from one disadvantage or another, and many suffer from plural disadvantages, including: complex circuitry; complex and unduly expensive construction; mains power supply; difficult installation; difficult replacement of a damaged screen; inability to sense all types of ingress; inconvenience.

SUMMARY OF THE INVENTION

It is, accordingly, an object of the invention to overcome deficiencies in the prior art, such as those indicated above.

It is another object to improve home or other building safety relative to unauthorized entry.

It is a further object of the present invention to provide an improved window screen alarm or protective screen embodying a burgular alarm.

It is still another object of the invention to provide an improved combination window screen and burglar alarm having, among others, the following advantages: closed circuit system; alarm upon either cutting or removal of the screen; optional strobe light in addition to sounding alarm; self-contained units for each window, each supplied with its own power source and alarm without necessity of internal wall or panel box wiring; reliability and durability; key switch for on-off and disarm; quick and easy installation in existing or new windows with no drilling, no wiring, no mess.

According to the invention, perimeter home security is achieved with a full screen wired in a closed circuit fashion connected to an individual battery powered alarm unit for each separate window. The full screen fits directly into its frame and an alarm box of small size, e.g. 2.5×6 inches and containing an audible alarm, a suitable (e.g. 9 volt) battery and an alarm circuit, is put under the interior seal or stool woodwork which is usually covered by drapes. If the screen is cut or pulled from its frame it will set off the alarm. The box also includes a key operated switch for arming or disarming the alarm circuit.

Other objects and advantages of the instant invention will become more apparent from the following detailed description of embodiments, taken in conjunction with the drawing, wherein:

DESCRIPTION OF EMBODIMENTS

Figure 1:
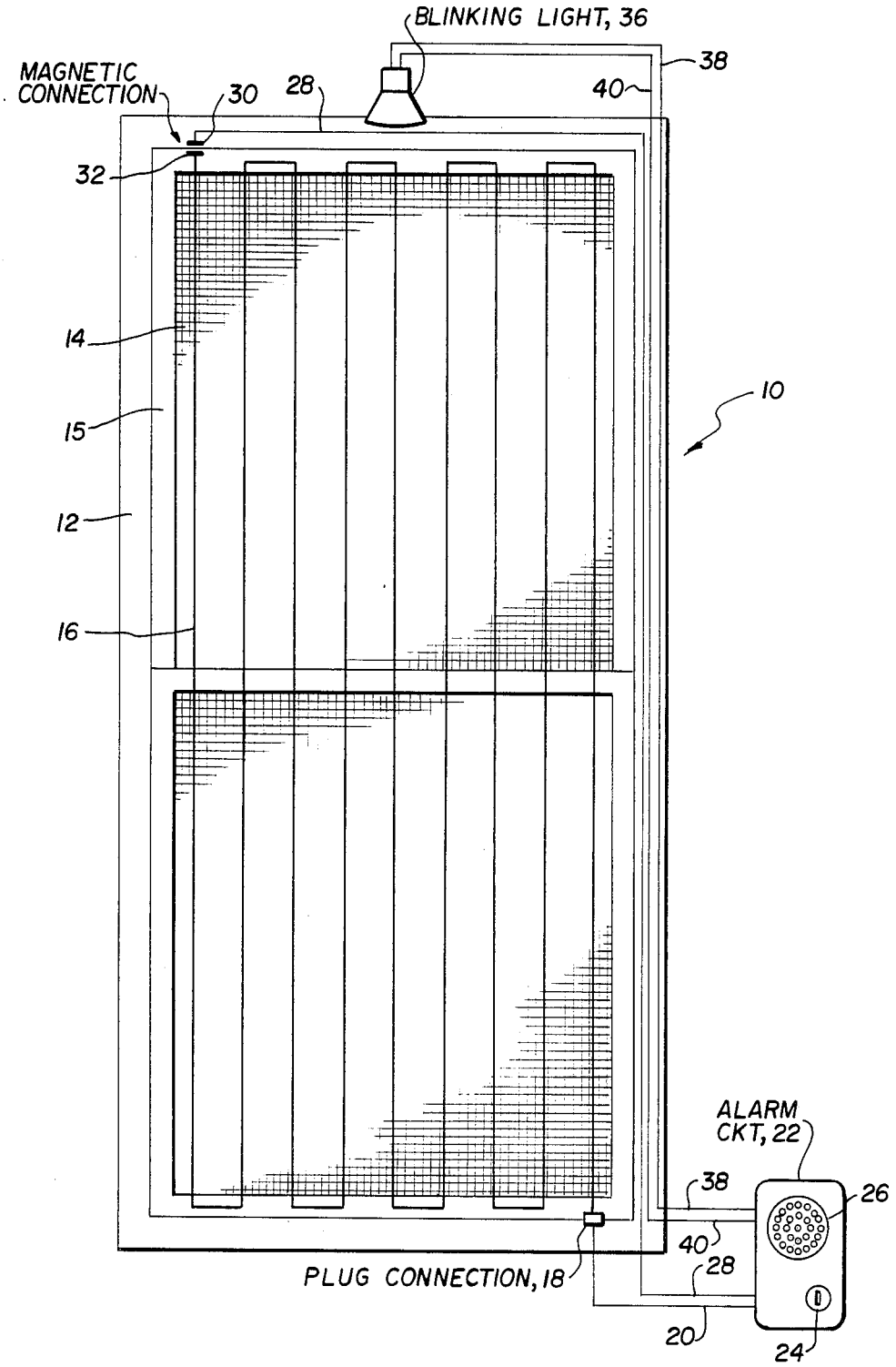
FIG. 1 is a partially schematic front elevational view of a first embodiment of a protective window screen with alarm according to the present invention.

FIG. 1 shows a first protective screen unit 10 according to the present invention comprising, located within a window frame 12, a screen frame 15 and a protective screen 14 having a first electrically conductive wire 16 passing therethrough in a plurality of loops, each vertical run of the wire 16 being separated from its adjacent neighbors by for example 4 inches, although larger or smaller intervals can be used, for example 2 inches or 6 inches separation. The screen 14 itself may be formed of conventional fiber glass screening and the first wire 16 is desirably formed of any suitably conductive metal such as copper covered with insulation. Although the first wire 16 may be a single wire, it is preferably composed of a plurality of parallel insulated wires, most preferably either two or three.

Connected to one end of the first wire 16 by means of a plug connection 18 to a first location of the screen 14 is a second electrically conductive wire 20 which passes from a circuit box 22 to a first part of the frame 12. The circuit box 22 contains an alarm circuit (e.g. see the aforementioned Willson U.S. Pat. No. 3,051,935) which is not shown in detail, but which includes a battery, preferably a 9 volt alkaline battery, a key operated switch accessible through the circuit box at 24, and an audible alarm the speaker 26 of which extends to the exterior of the circuit box 22. The audible alarm may be a box horn, buzzer or even a bell.

The plug connection 18 is an important feature of the invention, as it is one of the factors which permits easy replacement of the screen if it becomes damaged. Such plug connection has one element, either male or female, along the interior of the window frame 12, with the mating element being located at the first location along the exterior of the screen frame 15. Any type of plug connection can be used, such as the conventional pin and socket type (e.g. see the aforementioned Siegerdt U.S. Pat. No. 1,630,808), it being understood that other types of connections can also be used, such as a magnetic connection as described below.

A third electrically conductive wire 28 passes between the alarm circuit within the sounding box 22 to a conductive magnet 30 positioned in the frame 12 at a second part thereof such that it is exposed and in face-to-face contact with a second conductive, e.g. metal magnet 32, of opposite polarity, the second magnet 32 being at a second location of the screen frame 15. When the magnets 30 and 32 are in contact, an electrical connection is made between the first electrically conductive wire 16 and the third electrically conductive wire 28. If the screen 14 is forced out of its frame 12, or the first electrically conductive wire 16 is severed, then the circuit is broken. Desirably, the second location where the magnetic connection involving magnets 30 and 32 is situated is at a position diagonally opposite the first location of the plug connection 18, thereby making entry more difficult such as by merely tilting the screen or forcing one edge open.

It will be understood that when the circuit formed by the conductive wires 16, 20 and 28 is broken, same will close the alarm circuit to effect sounding of the audible alarm. It will also be understood that the combination window screen and burglar alarm 100 of FIG. 2 will be similar to that of FIG. 1 as so far described. It will also be understood that both the units 10 and 100 will desirably be provided with an optional blinking or strobe light 36.

In the unit 10 of FIG. 1, the blinking light 36 is connected by a pair of wires 38 and 40 which pass through the frame 12 adjacent the second electrically conductive wire 28 and which also lead to the alarm circuit. While this construction is simple in the sense of requiring only a single alarm circuit and circuit box, it has two minor disadvantages, namely the necessary provision of the additional wires 38 and 40 which must be passed through the frame 12, and the necessity for the 9 volt battery to power both the audible alarm and the strobe light, the latter requirement providing a light which may not be as bright as desirable in all cases.

Figure 2:
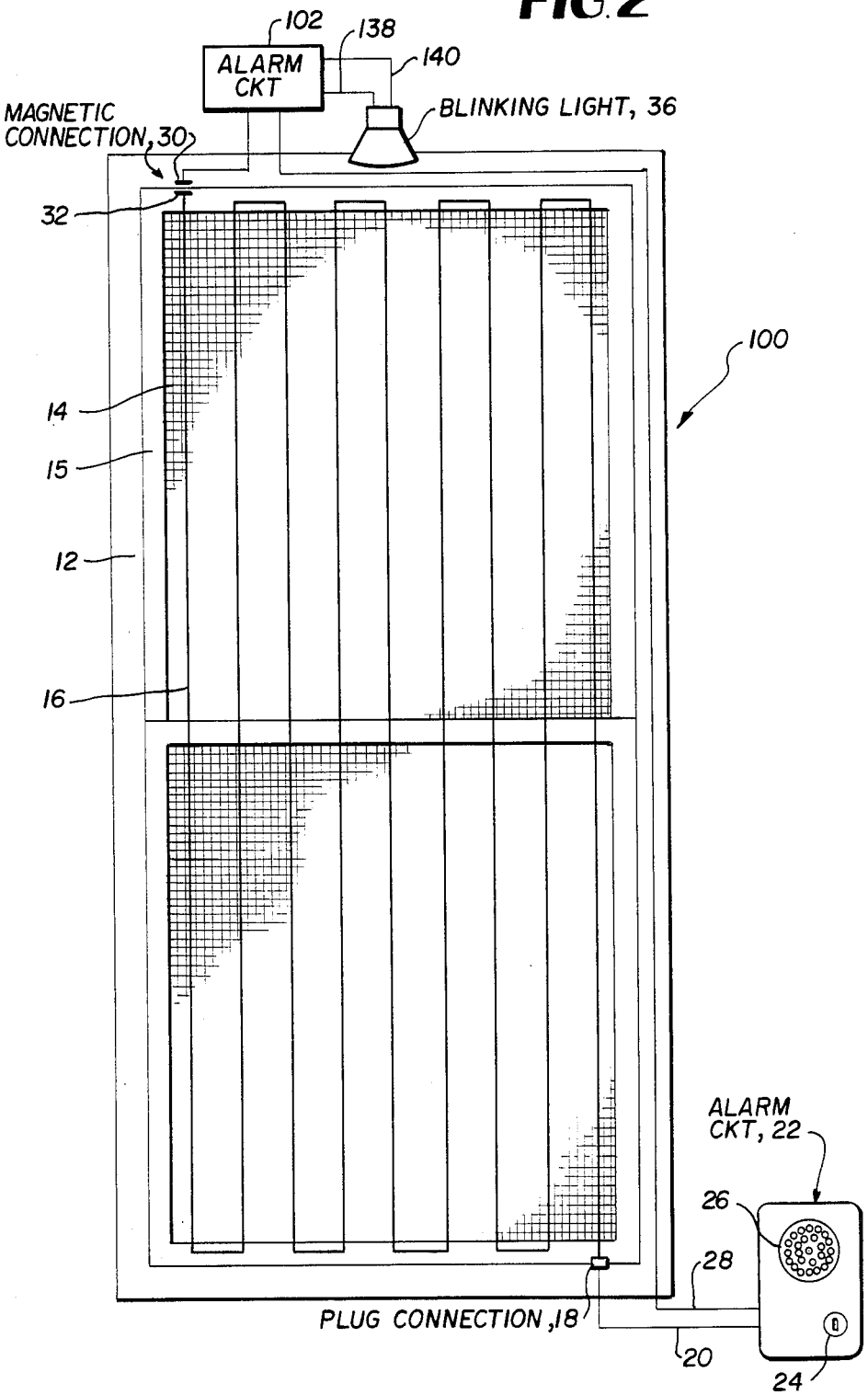
FIG. 2 is a similar view of a second embodiment.

According to the embodiment 100 of FIG. 2, wherein like elements are given like numbers, a second circuit box 102 is provided which contains a second alarm circuit and a second battery, e.g., a second 9 volt alkaline battery. Running from the second alarm circuit to the blinking light 36 are a pair of electrical wires 138 and 140. It will be understood that when the screen circuit is broken, the alarm circuits will then both be activated and the blinking light 36 will be somewhat brighter because it is powered by its own battery.

A third embodiment may be a hybrid of the units 10 and 100. Thus, in such a third embodiment the wiring may be the same as shown in FIG. 1 with additional conductive wires 38 and 40 passing to the blinking light. However, in accordance with the embodiment of FIG. 2, the circuit passing from the alarm circuit to the blinking light 36, and including the wires 38 and 40, may be interrupted by a 9 volt battery which may be conveniently located immediately above the light 36, or such battery may be located in the box 22 immediately before the wire 38 or 40. This embodiment provides the added power for the visual alarm 36 without the necessity of providing a second alarm circuit 102.

It will be obvious to those skilled in the art that various other changes and modifications may be made without departing from the scope of the invention and the invention is not to be considered limited to what is shown in the drawings and described in the specification.

What is claimed is:

1. A combination window screen and burglar alarm, comprising:

a window frame and a window screen disposed within said frame;

a first electrically conductive wire passing through said screen from a first location adjacent a first part of said frame to a second location adjacent a second part of said frame, said first conductive wire forming a plurality of loops within said screen;

a circuit box containing a key operated switch, a battery and an audible alarm in series, and forming an alarm circuit;

a second electrically conductive wire passing from said alarm circuit to said first part of said frame, and a disengagable connection at said first part of said frame for electrically connecting said first and second electrically conductive wires in series;

means for conducting electricity between said alarm circuit along said frame to said second part of said frame; and a first electrically conductive magnet at said second location of said screen and electrically connected to said first wire, and a second electrically conductive magnet at said second part of said frame and electrically connected to said means for conducting electricity between said alarm circuit and said second part of said frame, said first and second magnets being in facing relationship and of opposite polarity so as to be in tight contact with one another when said screen is in said frame, to form a closed loop circuit of said first wire, said second wire, said alarm circuit and said means for conducting electricity from said alarm circuit to said second part of said frame;

a visual alarm provided with its own battery;

means to connect said visual alarm to said closed loop circuit; and said alarm circuit constituting means for sounding said audible alarm when said closed loop circuit is broken.

2. A combination window screen and burglar alarm in accordance with claim 1 wherein said disengagable connection is a plug connection.

3. A combination window screen and burglar alarm in accordance with claim 1 wherein said visual alarm is provided with its own alarm circuit and is located along said closed loop circuit.

* * * * *